United States Patent [19]

Bogosh

[11] 4,127,992

[45] Dec. 5, 1978

[54] PERMANENT PIER PILING

[76] Inventor: Donald Bogosh, 2646 Willow St., Franklin Park, Ill. 60131

[21] Appl. No.: 806,157

[22] Filed: Jun. 13, 1977

[51] Int. Cl.[2] ..... E02B 17/00; E02D 31/00

[52] U.S. Cl. ..... 405/61; 165/45; 405/211; 405/218

[58] Field of Search ..... 61/36 A, 53, 54, 103, 61/102, 1 R; 165/45; 14/75

[56] References Cited

U.S. PATENT DOCUMENTS

| | | | |
|---|---|---|---|
| 3,170,299 | 2/1965 | Clarke | 61/54 X |
| 3,195,619 | 7/1965 | Tippmann | 165/45 X |
| 3,630,037 | 12/1971 | Howard | 61/36 A X |
| 3,807,491 | 4/1974 | Van Hulsen | 165/45 |
| 3,831,385 | 8/1974 | Hudson | 61/103 X |

*Primary Examiner*—Mervin Stein
*Assistant Examiner*—David H. Corbin
*Attorney, Agent, or Firm*—Robert E. Wagner; Gerald T. Shekleton

[57] ABSTRACT

A permanent pier piling for use in docks and the like in a body of water whereby an antifreeze solution within the piling circulates to distribute latent ground heat from the lower portion of the piling to the upper portion of the piling to maintain a fluid interface between the piling and the ice during the winter season.

5 Claims, 3 Drawing Figures

FIG. 1
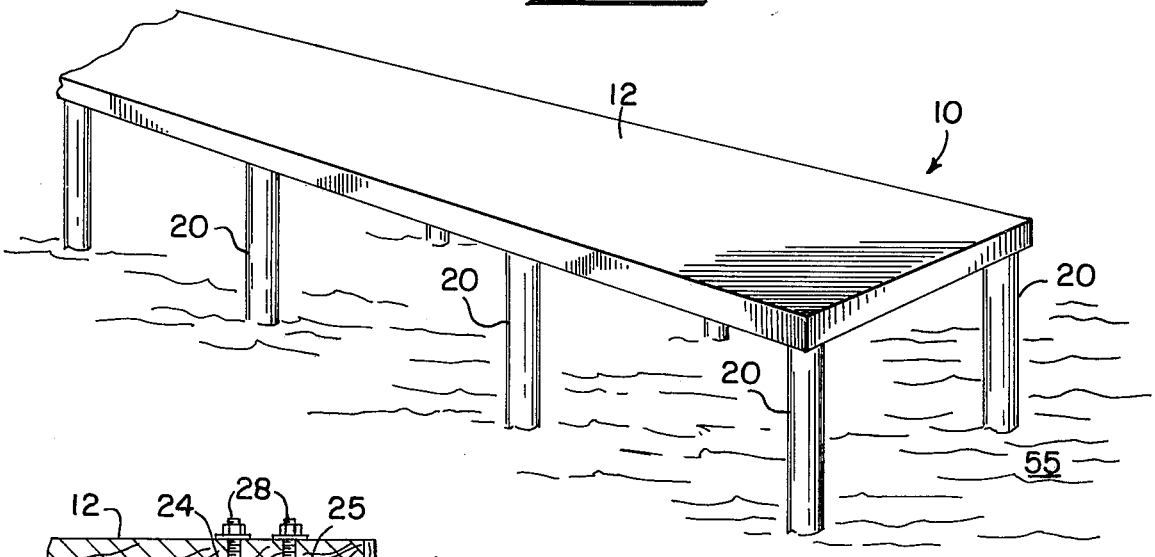
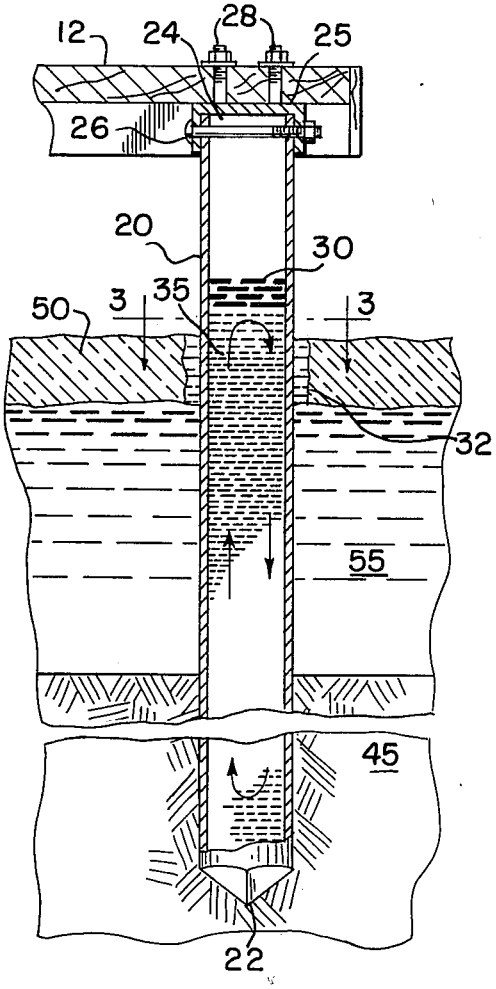
FIG. 2
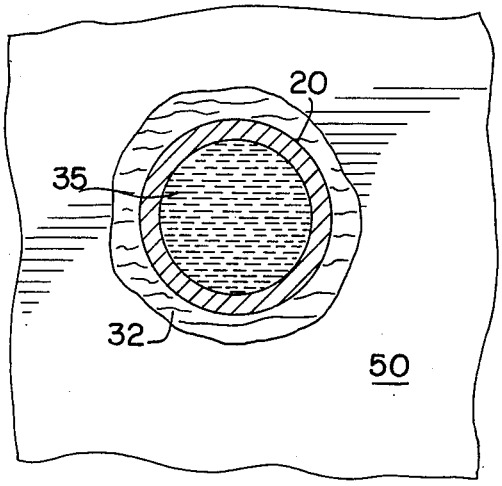
FIG. 3

PERMANENT PIER PILING

BACKGROUND OF THE INVENTION

This application relates to a device for protecting pier pilings and moorings and, more particularly, to a device for preventing the formation of ice about a pier piling or mooring.

Docks and the pilings supporting docks are generally subject to a seasonal existence, that is, they must be disassembled and withdrawn from the lake annually approaching winter and reconstructed each spring after the retreat of the cold weather. The phenomenom of seasonal freezing of bodies of water in northern climates causes ice to freeze about its top surface and seize any object on the water surface. Thus, the piling supports of docks and other lake-front structures and the moorings of marinas which may be immersed in the water in the winter are firmly gripped about their circumferences by the layer of ice thus formed on the top of the water.

As in warmer weather, the level of the body of water fluctuates widely during winter and does not remain at a constant level even while frozen, due to a variety of natural causes. With a change in the elevation of the ice, the firm grip which the ice retains about objects fixed in the body of water invariably causes the object to be dislodged upward from its ground support. In the case of pilings, the new upraised position in turn forces the dock or other structure supported by the piling to become warped and uneven to the extent that it is useless for bearing weight of any sort. In extreme cases, the pilings may be completely uprooted and the damage which is done to unprotected structures is an expensive annual problem. In the face of this certain rebuilding of a dock each year, dock owners customarily disassemble their dock each year, reusing the dock material the following year in order to avoid the cost of new material. This arduous task has led to the use by some of floating docks and floating moorings in marinas which are generally anchored in a rather loose fashion. The relative instability of these substitutes are tolerated only because of the unacceptability of pilings and, up to now, the unavailability of permanent pilings for docks and moorings.

Protective apparatus have also been used to isolate the piling from direct contact with the ice. In one instance, a sleeve was placed about the piling, the sleeve being freely moveable up and down the piling to thus insulate the piling from the changes in the level of the ice. While these protective sleeves worked satisfactorily for a short time, the battering absorbed by these sleeves soon deteriorated their effectiveness.

SUMMARY OF THE INVENTION

These and other objects are obtained in accordance with the present invention wherein there are provided permanent support pilings for a dock or moorings. These support pilings comprise conventional thick walled, cast iron, hollow piping sealed fluid tightly at one end. This sealed end is preferably pointed for easy driving into the bed of the water body. The piling is driven into the bed of the lake, river or other body of water in which it may be used and positioned at a desirable height above the surface of the water. The piling is of a length to extend to a depth below the frost line when driven into the water bed. A liquid or mixture of liquids known to have a freezing point or range below that of the lowest recorded temperature for the region in which the piling is being placed is introduced into the piling, reaching a height which will insure that the height of the liquid will always remain above that of the body of water. This liquid, or antifreeze solution as it is commonly known, may comprise a mixture of ethylene glycol and water, but, in any event, the prime characteristics of the liquid should be that it is nonvolatile, noncorrosive and of low viscosity at the temperatures of use. The piling may be capped prior to affixing the dock surface.

The antifreeze solution within the piling circulates, absorbing the latent heat of the bed of the water body through the piling wall, and, by natural convection currents the antifreeze solution rises to the upper surface portion of the liquid in the piling where it transfers its heat to the piling's environment, thereby keeping the area of water immediately adjacent the piling ice-free. The cooled antifreeze solution then reverses its direction and, continuing its circulation, descends to the lower depths of the pipe to renew the cycle. Due to the extension of the piling below the frost line, and, by virtue of the circulation of the antifreeze within the piling, the temperature of the antifreeze in the piling is kept above freezing, regardless of ambient conditions. Thus, the ice is precluded from forming about the piling and the piling is thereby left undisturbed by the changes of water levels due to natural occurrences.

A nonfreezing liquid of nonvolatile characteristics, immiscible with the antifreeze solution and of lower density than the antifreeze solution, for example, an oil or kerosene, may also be introduced into the piling to provide an upper layer which will retard the evaporation of the antifreeze solution.

SUMMARY OF THE INVENTION

It is accordingly an object of the subject invention to provide a means for preventing ice from causing damage to a dock or mooring.

A further object of the subject invention is to provide a permanent means of protecting pilings from the ravages and destructiveness of winter.

DESCRIPTION OF THE DRAWINGS

Further objects of the invention, together with additional features contributing thereto and advantages accruing therefrom will be apparent from the following description of one embodiment of the invention when read in conjunction with the accompanying drawings wherein:

FIG. 1 is a perspective view of a conventional dock supported by the inventive pilings of the subject invention;

FIG. 2 is a cross-sectional view showing the piling of the subject invention shown supporting a dock in the presence of ice; and, FIG. 3 is a cross-sectional view taken along the line 3—3 of FIG. 2 showing the piling being spaced from the ice.

DESCRIPTION OF A PREFERRED EMBODIMENT

Referring now to FIG. 1, there is shown a dock 10 and a body of water 55. The dock 10 has a surface 12 supported by pilings 20. It should be understood that while the subject invention is shown in use for the support of a dock surface, any type mooring which may be used at marinas and the like to secure vessels or other waterborne objects, is considered within the scope of the subject invention.

The piling 20 comprises a length of heavy walled cast iron piping of approximately 12 to 15 feet, and more in deep water areas. The piping 20 has a closed end 22 and an open end 24 (FIG. 2). The closed end 22 is fluid-tightly sealed and preferably pointed to aid in driving it into the bed 45 of the water body. The piling 20 of the subject invention is driven into the bed 45 by conventionally known means, such as pile drivers and the like. The depth to which the piling must normally be driven to attain the desired support for the dock or for use as a mooring would generally be of a sufficient depth for the purposes of the subject invention, as will hereinafter be explained.

Once the piling 22 is driven into the bed 45 of the body of water 55, a suitable antifreeze solution 35 is introduced into the piling 20. The amount of anitfreeze solution 35 in the piling should be sufficient to maintain a level above the high water level of the body of water. The antifreeze solution, as previously stated, should be of a noncorrosive and nonvolatile nature and capable of remaining fluid down to the lowest temperatures of the region where in use. Generally protection down to −30° F. is sufficient, although the far northern latitudes may require a lower freezing point of the liquid. As the piling is contemplated to be of a permanent nature, the characteristics of the liquids within the piling become as important as the stresses and other phenomenom occurring outside by natural forces to the piling 20. Thus, while some solutions might have a particularly low viscosity and high thermal transfer properties, their corrosiveness may cause such damage to the interior of the piling as to destroy the structural integrity or allow the antifreeze solution to leak from the pipe, thereby diluting the effectiveness of the antifreeze solution, and, eventually allowing ice to form about the piling.

A small amount of liquid 30, having a lower density than the density of the antifreeze solution 35 and sufficiently nonvolatile, such as oil or kerosene, may be also introduced into the piling 20 to provide an effective deterrent to evaporation of the antifreeze solution (FIG. 2). Of course, this lower density liquid 30 should not be miscible with the antifreeze solution 35.

After the introduction of the liquids 30 and 35 into the piling, a cap 25 may be placed on the piling and secured by suitable means such as a bolt and nut 26. This cap may have other bolts 28 integrally attached thereto to provide a means of securing the dock surface 12 to the mooring. While shown as being attached to the piling by nuts and bolts, any suitable means of securing the dock surface to the piling may be used. In this manner the introduction of foreign matter such as diluents or pebbles may be avoided.

When installed as above, the antifreeze solution 35 within the piling 20, absorbs the latent ground heat of that portion of the water bed 45 which is above the freezing temperature of water. Care must be taken to drive the piling deep enough so that it extends below the freeze or frost line of the ground in that particular vicintiy. Further, the piling 20 must extend sufficiently below this frost line into the ground 45 so that sufficient thermal contact may be made between the piling 20 and the ground 45. This depth is generally attained in the normal depths to which pilings are driven. In extreme northern latitudes, it may be found necessary to drive the pilings to a greater than normal depth. The latent heat in the ground 45 is absorbed by the antifreeze solution 35 within the pipe. Due to the natural process of convection, the antifreeze solution then circulates within the piling 20 so that the portion of the antifreeze solution 35 holding the absorbed latent heat of the ground 45 rises to the upper layers of the antifreeze solution 35. By this natural circulation of the antifreeze solution 35 (depicted by arrows in FIG. 2), no permanent strata may develop within the piling 20 which would isolate a portion of the solution at the uppermost levels, thereby causing the temperature of the solution to fall below 32 degrees and enable the ice 50 to form about the piling 20.

Thus, by the circulation of the antifreeze solution 35, the temperature of the piling 20 itself may be kept constantly above the freezing temperature of the water, thereby maintaining a fluid interface 32 with the ice 50 (FIG. 3). The interface 32 absorbs enough heat from the piling to remain liquid, thereby insuring that the ice will not form about the piling 20. In this manner, the level of the body of water 55 and the ice 50 may fluctuate without affecting the piling 20. While the interface 32 has been given a certain dimension, it should be understood that it may at times comprise only a small gap between the piling and the ice, though sufficient to deny the ice contact with the piling 20.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

I claim:

1. A hollow piling which is permanently embedded in a bed beneath a body of water, which water may have a fluctuating level, the piling having a construction for preventing ice from forming on the piling and forcing the piling upwardly when the water level changes comprising, in combination, a hollow pipe having outer walls and a lower end portion which is fluid-tightly sealed, a substantial length of the piling being embedded in the bed of the body of water, an antifreeze liquid within said pipe, said antifreeze liquid having an upper surface level above the high water level of the body of water, said piling and said antifreeze liquid extending into the bed a sufficient depth to transfer latent heat from the bed to said antifreeze liquid through said outer walls of said piling to develop a natural thermal convection current of said antifreeze liquid within said pipe and cycle said latent heat from the bed upwardly within said pipe, said natural thermal convection being the sole source of movement of said antifreeze liquid within said piling, said natural cycling being effective to retain the temperature of said antifreeze liquid above the freezing point of said body of water whereby said outer walls are heated by the cycling liquid sufficiently to prevent ice from forming around the walls of said piling at any level below the level of said antifreeze.

2. The piling of claim 1 wherein said lower end is pointed for easy driving into the water bed.

3. The piling of claim 1 wherein a liquid of lower density then said antifreeze liquid is introduced into said pipe, said second liquid being immiscible with said antifreeze liquid thereby causing a second liquid layer above said antifreeze solution, said second liquid layer preventing the evaporation of said antifreeze liquid.

4. The piling of claim 1 wherein said piling is capped to prevent the entrance of foreign material and the evaporation of said antifreeze liquid.

5. The piling of claim 1 wherein said antifreeze liquid is of low viscosity at the temperatures of use, noncorrosive and nonvolatile.

* * * * *